US006040098A

United States Patent [19]

Black et al.

[11] Patent Number: 6,040,098

[45] Date of Patent: Mar. 21, 2000

[54] SOLUTION SQUARYLIUM CHARGE GENERATION SYSTEMS INCORPORATING BINDER BLENDS

[75] Inventors: David Glenn Black, Longmont; Garry Dale Hinch, Superior; Dat Quoc Nguyen, Platteville; Kasturi Rangan Srinivasan, Longmont, all of Colo.

[73] Assignee: Lexmark International, Inc., Lexington, Ky.

[21] Appl. No.: 09/196,211

[22] Filed: Nov. 20, 1998

[51] Int. Cl.[7] ..... G03G 5/047

[52] U.S. Cl. ..... 430/59.6; 430/58.4; 430/96

[58] Field of Search ..... 430/96, 58.4, 59.6

[56] References Cited

U.S. PATENT DOCUMENTS

| | | | |
|---|---|---|---|
| 4,123,270 | 10/1978 | Heil et al. | 96/1.5 |
| 4,931,372 | 6/1990 | Takei et al. | 430/66 |
| 5,130,215 | 7/1992 | Adley et al. | 430/58 |
| 5,130,217 | 7/1992 | Champ et al. | 430/58 |
| 5,215,844 | 6/1993 | Badesha et al. | 430/96 |
| 5,529,867 | 6/1996 | Terrell et al. | 430/58 |
| 5,545,499 | 8/1996 | Balthis et al. | 430/59 |

*Primary Examiner*—Joan Goodrow
*Attorney, Agent, or Firm*—John A. Brady

[57] ABSTRACT

Charge generation layers comprising a binder and a charge generation compound, wherein the binder comprises a blend of methyl bisphenol A and an additional resin comprising an epoxy resin, a poly(phenylglycidyl ether)-co-dicyclopentadiene resin, a phenoxy resin or a polyhydroxystyrene resin. Dual layer photoconductors comprise the charge generation layer in combination with a substrate and a charge transport layer.

26 Claims, No Drawings

SOLUTION SQUARYLIUM CHARGE GENERATION SYSTEMS INCORPORATING BINDER BLENDS

FIELD OF THE INVENTION

The present invention is directed to charge generation layers which comprise a binder and a charge generation compound, wherein the binder comprises a blend of methyl bisphenol A and an additional resin comprising an epoxy resin, a poly(phenylglycidyl ether)-co-dicyclopentadiene resin, a phenoxy resin or a polyhydroxystyrene resin. The invention is also directed to photoconductors including such charge generation layers.

BACKGROUND OF THE INVENTION

In electrophotography, a latent image is created on the surface of an imaging member which is a photoconducting material by first uniformly charging the surface and selectively exposing areas of the surface to light. A difference in electrostatic charge density is created between those areas on the surface which are exposed to light and those areas on the surface which are not exposed to light. The latent electrostatic image is developed into a visible image by electrostatic toners. The toners are selectively attracted to either the exposed or unexposed portions of the photoconductor surface, depending on the relative electrostatic charges on the photoconductor surface, the development electrode and the toner.

Typically, a dual layer electrophotographic photoconductor comprises a substrate such as a metal ground plane member on which a charge generation layer (CGL) and a charge transport layer (CTL) are coated. The charge transport layer contains a charge transport material which comprises a hole transport material or an electron transport material. For simplicity, the following discussions herein are directed to the use of a charge transport layer which comprises a hole transport material as the charge transport compound. One skilled in the art will appreciate that if the charge transport layer contains an electron transport material rather than a hole transport material, the charge placed on the photoconductor surface will be opposite that described herein.

When the charge transport layer containing a hole transport material is formed on the charge generation layer, a negative charge is typically placed on the photoconductor surface. Conversely, when the charge generation layer is formed on the charge transport layer, a positive charge is typically placed on the photoconductor surface. Conventionally, the charge generation layer comprises the charge generation compound or molecule alone and/or in combination with a binder. The charge transport layer typically comprises a polymeric binder containing the charge transport compound or molecule. The charge generation compounds within the charge generation layer are sensitive to image-forming radiation and photogenerate electron hole pairs therein as a result of absorbing such radiation. The charge transport layer is usually non-absorbent of the image-forming radiation and the charge transport compounds serve to transport holes to the surface of a negatively charged photoconductor. Photoconductors of this type are disclosed in the Adley et al U.S. Pat. No. 5,130,215 and the Balthis et al U.S. Pat. No. 5,545,499.

The Champ et al U.S. Pat. No. 5,130,217 discloses dual layer photoconductors wherein the charge generation layer comprises solution squarylium formulations. Champ et al found that high molecular weight polymers containing carbonyl or sulfonyl groups degrade in the presence of amine solvents. Arylsulfonamide resins have been used to form solution squarlyium formulations, but the formulations typically must be used within a short time, for example thirty minutes, to ensure good coating quality and spectral properties. Other high molecular weight polymers which have been found to be stable in basic amine solvents were found to exhibit poor coating quality and/or unacceptable electrical photographic properties, e.g., high residual voltage and dark decay.

Squarylium dyes are thought to possess a preferred aggregation or intermolecular stacking which optimizes electronic transitions between molecules. As disclosed in Champ et al, binder systems which do not interfere with this stacking arrangement are preferred. The methyl bisphenol A (60% weight)/bisphenol A (40% weight) (MeBPA/BPA respectively) system disclosed by Champ et al allows aggregate formation because the polymers comprise small molecules. A mixture of these binders is used to minimize crystallization.

The squarylium-containing charge generation layers as disclosed by Champ et al are advantageous in that they provide good electrophotographic properties to dual layer photoconductors. In order to provide such photoconductors with improved durability, it would be advantageous to improve their abrasion resistance, and particularly resistance to layer delamination, while maintaining good electrophotographic properties.

SUMMARY OF THE INVENTION

Accordingly, it is an object of the present invention to provide novel charge generation layers which provide improvements over prior art layers. It is a more specific object of the invention to provide charge generation layers which contribute good electrophotographic properties to photoconductors in which they are employed. It is a further object to provide charge generation layers which exhibit good adhesion to adjacent layers when employed in a multi-layer photoconductor, and particularly a dual layer photoconductor.

These and additional objects and advantages are provided by charge generation layers and photoconductors of the present invention. The charge generation layers according to the present invention comprise a binder and a charge generation compound, wherein the binder comprises a blend of methyl bisphenol A and an additional resin which comprises an epoxy resin, a poly(phenylglycidyl ether)-co-dicyclopentadiene resin, a phenoxy resin or a polyhydroxystyrene resin. Preferably, the binder comprises a blend of methyl bisphenol A and polyhydroxystyrene novolak. The photoconductors according to the present invention comprise a substrate, a charge generation layer, and a charge transport layer, wherein the charge generation layer comprises a binder and a charge generation compound. The binder comprises a blend of methyl bisphenol A and an additional resin which comprises an epoxy resin, a poly (phenylglycidyl ether)-co-dicyclopentadiene resin, a phenoxy resin or polyhydroxystyrene resin.

The binders according to the present invention surprisingly provide a stable solution of charge generation compound from which the charge generation layer may be formed. The charge generation layers exhibit good adhesion to adjacent layers, particularly photoconductor substrates, while maintaining or improving electrophotography characteristics of the photoconductors. Photoconductors including the charge generation layers of the invention exhibit low dark decay and good sensitivity. These and additional objects and advantages will be more readily apparent in view of the following detailed description.

DETAILED DESCRIPTION

The charge generation layers according to the present invention are suitable for use in dual layer photoconductors. Such photoconductors generally comprise a substrate, a charge generation layer and a charge transport layer. While various embodiments of the invention discussed herein refer to the charge generation layer as being formed on the substrate, with the charge transport layer formed on the charge generation layer, it is equally within the scope of the present invention for the charge transport layer to be formed on the substrate with the charge generation layer formed on the charge transport layer.

The charge generation layers according to the present invention comprise a binder and a charge generation compound. Various organic and inorganic charge generation compounds are known in the art, any of which are suitable for use in the charge generation layers of the present invention. One type of charge generation compound which is particularly suitable for use in the charge generation layers of the present invention comprises the squarylium-based pigments, including squaraines. Squarylium pigment may be prepared by an acid route, for example as described in U.S. Pat. Nos. 3,617,270, 3,824,099, 4,175,956, 4,486,520 and 4,508,803, which employs simple procedures and apparatus, has a short reaction time and is in high yield. The squarylium pigment is therefore very inexpensive and easily available.

Preferred squarylium pigments suitable for use in the present invention may be represented by the structural formula (I) wherein $R_1$ represents hydroxy, hydrogen or $C_1$–$C_5$ alkyl, preferably hydroxy, hydrogen or methyl, and each $R_2$ individually represents $C_1$–$C_5$ alkyl or hydrogen.

(I)

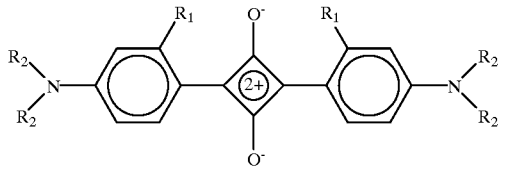

In a further preferred embodiment, the pigment comprises a hydroxy squaraine pigment wherein each $R_1$ in the formula (I) set forth above comprises hydroxy.

In accordance with an important feature of the invention, the charge generation layer binder comprises a blend of resin components. Specifically, the blend comprises methyl bisphenol A and an additional resin wherein the additional resin comprises an epoxy resin, a poly(phenylglycidyl ether)-co-dicyclopentadiene resin, a phenoxy resin or a polyhydroxystyrene resin. These additional resins are known in the art and are commercially available from various sources. Mixtures of two or more of these additional resins may also be employed. In a preferred embodiment of the invention, the binder comprises a blend of methyl bisphenol A and a polyhydroxystyrene novolak. The present inventors have discovered these binder blends surprisingly form stable solutions with charge generation compounds and allow formation of charge generation layers having good adhesion to adjacent layers while maintaining or improving electrical characteristics of photoconductors in which the charge generation layers are included. Particularly, the binder blends provide the photoconductors with good electrical characteristics such as low dark decay, good sensitivity and/or the like.

Typically, the binder comprises the methyl bisphenol A and the additional resin in a weight ratio of about 1:50 to about 50:1 and preferably comprises the methyl bisphenol A and the additional resin in a weight ratio of from about 1:20 to about 20:1. In further preferred embodiments, the binder comprises the methyl bisphenol A and the additional resin in a weight ratio of from about 5:1 to about 1:5. In yet further preferred embodiments, the weight ratio is from about 4:1 to about 1:2.

The charge generation layers may comprise the charge generation compound and the binder in amounts conventionally used in the art. Typically, the charge generation layer comprises from about 5 to about 80 weight percent of the charge generation compound, preferably comprising from about 10 to about 40 weight percent of the charge generation compound, and more preferably comprising from about 15 to about 40 weight percent of the charge generation compound, and may comprises from about 20 to about 95 weight percent of the binder, preferably comprising from about 60 to about 90 weight percent of the binder, and more preferably comprising from about 60 to about 85 weight percent of the binder, all weight percentages being based on the weight of the charge generation layer. The charge generation layers may further contain any conventional additives known in the art for use in charge generation layers.

As discussed above, the charge generation layers according to the present invention exhibit good adhesion to adjacent layers. Typically, the charge generation layer will be applied to the photoconductor substrate, with a charge transport layer formed on the charge generation layer. In accordance with techniques known in the art, one or more barrier layers may be provided between the substrate and the charge generation layer. Typically, such barrier layers have a thickness of from about 0.05 to about 20 microns. It is equally within the scope of the present invention that the charge transport layer is first formed on the photoconductor substrate, followed by the formation of the charge generation layer on the charge transport layer.

The photoconductor substrate may be flexible, for example in the form of a flexible web or a belt, or inflexible, for example in the form of a drum. Typically, the photoconductor substrate is uniformly coated with a thin layer of a metal, preferably aluminum, which functions as an electrical ground plane. In a preferred embodiment, the aluminum is anonized to convert the aluminum surface into a thicker aluminum oxide surface. Alternatively, the ground plane member may comprise a metallic plate formed, for example, from aluminum or nickel, a metal drum or foil, or plastic film on which aluminum, tin oxide, indium oxide or the like is vacuum evaporated. Typically, the photoconductor substrate will have a thickness adequate to provide the required mechanical stability. For example, flexible web substrates generally have a thickness from about 0.01 to about 0.1 microns, while drum substrates generally have a thickness of from about 0.75 mm to about 1 mm.

The charge transport layer included in the dual layer photoconductors of the present invention comprises binder and a charge transport compound. In addition, the charge transport layer can also comprise acetosol yellow as disclosed by Anderson et al U.S. Pat. No. 4,362,798. The charge transport layer is in accordance with conventional practices known in the art and therefore may include any binder and any charge transport compound generally known in the art for use in dual layer photoconductors. Typically, the binder is polymeric and may comprise, but is not limited to, vinyl polymers such as polyvinylchloride, polyvinylbutyral, polyvinyl acetate, styrene polymers, and copolymers of these vinyl polymers, acrylic acid and acrylate polymers and copolymers, polycarbonate polymers and copolymers, including polycarbonate-A, which is derived from bisphenol A, polycarbonate-Z, which is derived from cyclohexylidene bisphenol, polycarbonate-C, which derived from methyl bisphenol A, polyestercarbonates, polyesters, alkyd resins, polyamides, polyurethanes, epoxy resins and the like. Preferably, the polymeric binder of the charge transport layer is inactive, i.e., it does not exhibit charge transport properties.

Conventional charge transport compounds suitable for use in the charge transport layer of the photoconductors of the present invention should be capable of supporting the injection of photogenerated holes or electrons from the charge generation layer and allowing the transport of these holes or electrons to the charge transport layer to selectively discharge the surface charge. Suitable charge transport compounds for use in the charge transport layer include, but are not limited to, the following:

1. Pyrazoline transport molecules as disclosed in U.S. Pat. Nos. 4,315,982, 4,278,746 and 3,837,851.
2. Substituted fluorene charge transport molecules as described in U.S. Pat. No. 4,245,021.
3. Oxadiazole transport molecules such as 2,5-bis(4-diethylaminophenyl)-1,3,4-oxadiazole, imidazole, triazole, and others as described in German Patents Nos. 1,058,836, 1,060,260 and 1,120,875 and U.S. Patent No. 3,895,944.
4. Hydrazone transport molecules including p-diethylaminobenzaldehyde-(diphenylhydrazone), p-diphenylaminobenzaldehyde-(diphenylhydrazone), o-ethoxy-p-diethylaminobenzaldehyde-(diphenylhydrazone), o-methyl-p-diethylaminobenzaldehyde-(diphenylhydrazone), o-methyl-p-dimethylaminobenzaldehyde (diphenylhydrazone), p-dipropylaminobenzaldehyde-(diphenylhydrazone), p-diethylaminobenzaldehyde-(benzylphenylhydrazone), p-dibutylaminobenzaldehyde-(diphenylhydrazone), p-dimethylaminobenzaldehyde-(diphenylhydrazone) and the like described, for example, in U.S. Pat. No. 4,150,987. Other hydrazone transport molecules include compounds such as 1-naphthalenecarbaldehyde 1-methyl-1-phenylhydrazone, 1-naphthalenecarbaldehyde 1,1-phenylhydrazone, 4-methoxynaphthlene-1-carbaldehyde 1-methyl-1-phenylhydrazone and other hydrazone transport molecules described, for example, in U.S. Pat. Nos. 4,385,106, 4,338,388, 4,387,147, 4,399,208 and 4,399,207. Yet other hydrazone charge transport molecules include carbazole phenyl hydrazones such as 9-methylcarbazole-3-carbaldehyde-1,1-diphenylhydrazone, 9-ethylcarbazole-3-carbaldehyde-1-methyl-1-phenylhydrazone, 9-ethylcarbazole-3-carbaldehyde-1-ethyl-1-phenylhydrazone, 9-ethylcarbazole-3-carbaldehyde-1-ethyl-1-benzyl-1-phenylhydrazone, 9-ethylcarbazole-3-carbaldehyde-1,1-diphenylhydrazone, and other suitable carbazole phenyl hydrazone transport molecules described, for example, in U.S. Pat. No. 4,256,821. Similar hydrazone transport molecules are described, for example, in U.S. Pat. No. 4,297,426. Preferred hydrazone transport molecules include derivatives of aminobenzaldehydes, cinnamic esters or hydroxylated benzaldehydes. Exemplary amino benzaldehyde-derived hydrazones include those set forth in the Anderson et al U.S. Pat. Nos. 4,150,987 and 4,362,798, while exemplary cinnamic ester-derived hydrazones and hydroxylated benzaldehyde-derived hydrazones are set forth in the copending Levin et al U.S. application Ser. Nos. 08/988,600 and 08/988,791, respectively, all of which patents and applications are incorporated herein by reference.

The charge transport layer typically comprises the charge transport compound in an amount of from about 5 to about 60 weight percent, based on the weight of the charge transport layer, and more preferably in an amount of from about 15 to about 40 weight percent, based on the weight of the charge transport layer, with the remainder of the charge transport layer comprising the binder, and any conventional additives.

The charge transport layer will typically have a thickness of from about 10 to about 40 microns and may be formed in accordance with conventional techniques known in the art.

Conveniently, the charge transport layer may be formed by dispersing or dissolving the charge transport compound and a polymeric binder in organic solvent, coating the dispersion and/or solution on the respective underlying layer and drying the coating. Likewise, the charge generation layer may be formed by dissolving or dispersing the charge generation compound and the polymeric binders in organic solvent, coating the solution or dispersion on the respective underlying layer and drying the coating.

The following examples demonstrate various embodiments and advantages of the charge generation layers and photoconductors according to the present invention. In the examples and throughout the present specification, parts and percentages are by weight unless otherwise indicated.

EXAMPLE 1

In this example, a photoconductor 1A according to the present invention and comparative photoconductors 1B and 1C were prepared using a charge generation layer according to the present invention and comparative charge generation layers, respectively. Each of the photoconductors described in this Example was prepared by dip-coating a charge generation layer solution on an anodized aluminum drum substrate and drying to form the charge generation layer, followed by dip-coating a charge transport layer solution on the charge generation layer. In each photoconductor of this Example, the charge transport layer comprised about 60 weight percent of a bisphenol A-polycarbonate polymer (Makrolon-5208 supplied by Bayer) and about 40 weight percent of a charge transport compound comprising p-diethylaminebenzaldehyde (diphenylhydrazone) (DEH).

The charge generation layer of the inventive and comparative photoconductors comprised about 20 weight percent hydroxy squaraine ((2,4-bis(4-dimethylamino-2-hydroxyphenyl)cyclobutenediylium-1,3-diolate)) (HOSQ) and about 80 weight percent binder. The binder in the charge generation layer of the photoconductor 1A according to the present invention comprised a blend of 70% methyl bisphenol A and 30% polyhydroxystyrene novolak. The binder in the charge generation layer of the comparative photoconductor 1B comprised a blend of 60% methyl bisphenol A and 40% bisphenol A. The binder in the charge generation layer of the photoconductor 1C comprised 100% polyhydroxystyrene novolak.

Optical density, residual image and various electrical characteristics of the photoconductors described in this Example were examined. Specifically, Isopel optical density was measured by a scanner (Scan Jet 3P Hewlett Packard) of 600 DPI single pel dots arranged in a checkerboard pattern. Dark decay, which is the loss of charge from the surface of the photoconductor when it is maintained in the dark, was also measured. Dark decay is an undesirable feature as it reduces the contrast potential between image and background areas, leading to washed out images and loss of gray scale. Dark decay also reduces the field that the photoconductor process will experience when light is brought back to the surface, thereby reducing the operational efficiency of the photoconductor. In addition, sensitivity measurements were made using an electrostatic sensitometer fitted with electrostatic probes to measure the voltage magnitude as a function of light energy shining on the photoconductive surface using a 780 nm laser. The drum was charged by a Corona and the expose to develop time for all measurements was 222 milliseconds. The photosensitivity was measured as a discharge voltage on the photoconductor drum previously charged to about −650 V, measured at a light energy of 0.75 $\mu J/cm^2$.

The drum optical density of the photoconductors was also measured. Specifically, drum optical density was measured using a MacBeth TR524 sensitometer.

Adhesive properties of the photoconductors were tested using a tape lift-off test and an adhesion tester. Specifically, the tape lift-off test is an American Standard Test Method (ASTM) for evaluating adhesion properties. The drum is scratched with a razor blade to give a tic-tac-toe pattern with boxes approximately 1–2 $mm^2$. Tape is applied to this surface and removed. If most of the coating is removed along with the tape, then the drum receives a score of 5; if most of the coating remains, then the drum receives a score of 0. Values between 1 and 4 are assigned to drums between these extremes. The adhesion tester provides a secondary means of quantifying adhesion. A coated drum is exposed to three pounds of force per inch squared, as applied by three brass wheels located at the top, middle, and bottom of the drum. The drum revolves 360 times per minute. Adhesion is measured in seconds; the drum fails when the coating bubbles, indicating that adhesive integrity (either charge generation layer-substrate or charge generation-charge transport layer) has been lost. In addition, the printed pages were inspected to determine if a residual image existed. A residual image is the appearance of an image from the preceding page that was printed.

The results of the described measurements are set forth in Table 1.

The results set forth in Table 1 demonstrate that the photoconductor 1A comprising a charge generation layer according to the present invention and containing a binder blend of 70% methyl bisphenol A and 30% polyhydroxystyrene novolak exhibited increased sensitivity (as indicated by a lower voltage at 0.75 $\mu J/cm^2$) and lower residual voltage. In addition, prints derived from this drum did not show a residual image. As noted in Table 1, the adhesion of the charge generation layer to the metal substrate was also dramatically improved. The improvements exhibited by photoconductor 1A are surprising since photoconductor 1C, which comprised a CGL binder of 100% polyhydroxystyrene novolak, exhibited very high dark decay which would prevent its use as a photoconductor. Print evaluations were not performed for the photoconductor 1C due to the very high dark decay (247 V/sec). One of ordinary skill in the art would therefore find it surprising that a CGL binder comprising a blend of methyl bisphenol A and polyhydroxystyrene novolak provides a photoconductor with good photoelectrical and print properties, and good mechanical durability.

EXAMPLE 2

In this Example, additional photoconductors 2A–2D according to the present invention and additional comparative photoconductors 2E and 2F were prepared comprising charge generation layers according to the present invention and comparative charge generation layers, respectively. Each photoconductor was prepared using the general procedures described in Example 1. The charge transport layer for the photoconductors of this Example comprised the same charge transport layer as detailed in Example 1.

The composition of the charge generation layers or the respective photoconductors according to this Example are described in Table 2. As will be apparent from Table 2, photoconductors 2A–2D contained charge generation layers according to the present invention wherein the binder comprised a blend of methyl bisphenol A and polyhydroxystyrene novolak while comparative photoconductors 2E and 2F contained charge generation layers wherein the binder comprised a blend of about 60% methyl bisphenol A and about 40% bisphenol A.

TABLE 1

| Photo-conductor | CG Binder | Drum OD | Initial Charge (−V) | Voltage @ 0.75 $\mu J/cm^3$ (−V) | Residual Charge (−V) | Dark Decay (V/sec) | Isopel OD | Residual Image | Tape Lift Off | Adhesion Tester (sec.) |
|---|---|---|---|---|---|---|---|---|---|---|
| 1A | 70/30 MeBPA/ PHS novolak | 1.41 | 608 | 195 | 148 | 41.02 | 0.74 | none | 1 | <300 |
| 1B | 60/40 MeBPA/ BPA | 1.47 | 612 | 222 | 196 | 15.12 | 0.67 | moderate | 4 | 30 |
| 1C | 100% PHS Novolak | 1.55 | 598 | 200 | 198 | 247 | — | — | 1 | <300 |

TABLE 2

| | Photoconductor | | | | | |
|---|---|---|---|---|---|---|
| | 2A | 2B | 2C | 2D | 2E | 2F |
| BPA, wt % | — | — | — | — | 32 | 32 |
| MeBPA, wt % | 56 | 60 | 56 | 60 | 48 | 48 |
| PHS novolak, wt % | 24 | 20 | 24 | 20 | — | — |
| HOSQ, wt % | 20 | 20 | 20 | 20 | 20 | 20 |
| % solids in CGL solution | 3.5 | 3.5 | 4.0 | 4.0 | 3.5 | 4.0 |

The photoconductors of this Example were subjected to measurement of optical density, dark decay, photosensitivity and residual voltage according to the procedures described in Example 1. The results of these measurements are set forth in Table 3. In addition, two print measures, the isopel optical density and the residual image, were also measured at varying environmental conditions comprising (1) cold and dry, and (2) hot and wet, wherein cold and dry comprises 60° F. and 08% relative humidity and wherein hot and wet comprises 78° F. and 80% relative humidity. T he results of these measurements are set forth in Table 4.

TABLE 3

| Photo-conuctor | CT layer Coat Weight (mg/in$^2$) | Drum OD | Initial Charge (−V) | Voltage @ 0.75 $\mu$J/cm$^2$ (−V) | Residual Charge (−V) | Dark Decay (V/sec) |
|---|---|---|---|---|---|---|
| 2A | 19.5 | 1.5 | 611 | 235 | 184 | 29.9 |
| 2B | 19.5 | 1.6 | 610 | 224 | 189 | 24.8 |
| 2C | 19.5 | 1.6 | 609 | 212 | 171 | 28.5 |
| 2D | 19.5 | 1.6 | 609 | 215 | 176 | 29.4 |
| 2E | 19.1 | 1.6 | 610 | 248 | 196 | 11.2 |
| 2F | 19.5 | 1.6 | 610 | 230 | 188 | 14.8 |

As set forth in Table 3, the photoconductors 2A–2D comprising a charge generation layer according to the present invention exhibited substantially equivalent or increased sensitivity (as indicated by a lower voltage at 0.75 $\mu$J/cm$^2$) and lower residual voltage as compared with comparative photoconductors 2E and 2F.

TABLE 4

| Photoconductor | Isopel OD | Residual Image |
|---|---|---|
| 2A* | 0.7 | very slight |
| cold/dry** | 0.5 | slight |
| hot/wet*** | 0.5 | slight |
| 2B | 0.6 | very slight |

TABLE 4-continued

| Photoconductor | Isopel OD | Residual Image |
|---|---|---|
| cold/dry | 0.5 | very slight |
| hot/wet | 0.5 | slight |
| 2C | 0.7 | slight |
| cold/dry | 0.6 | moderate |
| hot/wet | 0.6 | slight |
| 2D | 0.8 | moderate |
| cold/dry | 0.6 | moderate |
| hot/wet | 0.6 | moderate |
| 2E | 0.7 | moderate |
| cold/dry | 0.6 | severe |
| hot/wet | 0.8 | very slight |
| 2F | 0.9 | very slight |
| cold/dry | 0.7 | moderate |
| hot/wet | 0.9 | very slight |

*ambient 75° F./40% relative humidity
**60° F./08% relative humidity
***78° F./80% relative humidity As set forth in Table 4, the isopel optical density for all of the photoconductors was relatively constant at all environments, and the residual image properties of photoconductors 2A–2B were similar to those of comparative photoconductor 2F (control at 4.0% solids), and improved over those of comparative photoconductor 2E (control at 3.5% solids). In addition, this Example also demonstrates the print stability of the methyl bisphenol A and polyhydroxystyrene novolak binder system at different environmental conditions.

EXAMPLE 3

In this Example, additional photoconductor 3A according to the present invention and a comparative photoconductor 3B were prepared using the general procedures described in Example 1. The charge transport layer of the respective photoconductors remained the standard 40% DEH charge transport layer formulation as described in Example 1. The charge generation layer of photoconductor 3A according to the present invention comprised a binder of 80% methyl bisphenol A and 20% polyhydroxystyrene novolak. The charge generation layer of photoconductor 3B comprised a binder containing 60% methyl bisphenol A and 40% bisphenol A. The charge generation layer of each photoconductor was formed utilizing procedures as described in Example 1.

The photoconductors of this Example were subjected to measurement of optical density, dark decay, photosensitivity, black average optical density (OD) at low print density, streak average OD at medium print density, and percent toner coverage. The adhesive properties of the charge generation layers were also measured using the tape lift-off test as described in Example 1. The results of these measurements are set forth in Table 5.

TABLE 5

| Photo-conductor | Drum OD | Initial Charge (−V) | Voltage @ 0.75 $\mu$J/cm$^2$ (−V) | Residual Charge (−V) | Dark Decay (V/sec) | Black Avg. OD @ Low Print Density | Streak Avg OD @ Med. Print Density | Percent Coverage | Tape Lift Off |
|---|---|---|---|---|---|---|---|---|---|
| 3A | 1.2 | 617 | 191 | 183 | 67.8 | 1.4 | 0.8 | 5.7 | 1 |
| 3B | 1.1 | 700 | 187 | 182 | 49.4 | 1.4 | 1.0 | 6.1 | 4 |

From the results set forth in Table 5, one of ordinary skill in the art will recognize that the photoconductor 3A according to the invention has the same black average optical density as the comparative photoconductor 3B, while providing a lower, more preferred OD for the streak page. In addition, the toner usage, as measured by percent coverage, is lower (and more preferred) for the photoconductor 3A according to the invention. The photoconductor 3A of the present invention also exhibited significantly better adhesion than photoconductor 3B.

Thus, these Examples demonstrate that the photoconductors according to the present invention exhibit good electrical characteristics and charge generation layers thereof exhibit good adhesion to the underlying substrate.

The various preferred embodiments and examples set forth herein are presented in order to further illustrate the claimed invention and are not intended to be limiting thereof. Additional embodiments and alternatives within the scope of the claimed invention will be apparent to those of ordinary skill in the art.

We claim:

1. A charge generation layer, comprising a binder and a charge generation compound, wherein the binder comprises a blend of methyl bisphenol A and an additional resin comprising an epoxy resin, a poly(phenylglycidyl ether)-co-dicyclopentadiene resin, a phenoxy resin or a polyhydroxystyrene resin.

2. A charge generation layer as defined by claim 1, wherein the charge generation compound comprises a squarylium pigment.

3. A charge generation layer as defined by claim 1, wherein the charge generation compound comprises a hydroxy-substituted squarylium pigment.

4. A charge generation layer as defined by claim 1, wherein the binder comprises the methyl bisphenol A and the additional resin in a weight ratio of from about 1:20 to about 20:1.

5. A charge generation layer as defined by claim 1, wherein the binder comprises the methyl bisphenol A and the additional resin in a weight ratio of from about 5:1 to about 1:5.

6. A charge generation layer as defined by claim 1, comprising from about 5 to about 80 weight percent of the charge generation compound and from about 20 to about 95 weight percent of the binder.

7. A charge generation layer as defined by claim 1, comprising from about 10 to about 40 weight percent of the charge generation compound and from about 60 to about 90 weight percent of the binder.

8. A charge generation layer as defined by claim 1, wherein the binder comprises of a blend of methyl bisphenol A and polyhydroxystyrene novolak.

9. A charge generation layer as defined by claim 8, wherein the charge generation compound comprises a hydroxy-substituted squarylium pigment.

10. A charge generation layer as defined by claim 8, wherein the binder comprises the methyl bisphenol A and the polyhydroxystyrene novolak in a weight ratio of from about 1:20 to about 20:1.

11. A charge generation layer as defined by claim 8, wherein the binder comprises the methyl bisphenol A and the polyhydroxystyrene novolak in a weight ratio of from about 5:1 to about 1:5.

12. A charge generation layer as defined by claim 8, comprising from about 10 to about 40 weight percent of the charge generation compound and from about 60 to about 90 weight percent of the binder.

13. A charge generation layer as defined by claim 1, comprising from about 10 to about 40 weight percent of the charge generation compound and from about 60 to about 90 weight percent of the binder, wherein the binder comprises the methyl bisphenol A and a polyhydroxystyrene resin in a weight ratio of from about 5:1 to about 1:5 and wherein the charge generation compound comprises a squarylium pigment.

14. A photoconductor, comprising a substrate, a charge generation layer and a charge transport layer, wherein the charge generation layer comprises a binder and a charge generation compound, and further wherein the binder comprises a blend of methyl bisphenol A and an additional resin comprising an epoxy resin, a poly(phenylglycidyl ether)-co-dicyclopentadiene resin, a phenoxy resin or a polyhydroxystyrene resin.

15. A photoconductor as defined by claim 14, wherein the charge generation compound comprises a squarylium pigment.

16. A photoconductor as defined by claim 14, wherein the charge generation layer comprises from about 10 to about 40 weight percent of the charge generation compound and from about 60 to about 90 weight percent of the binder.

17. A photoconductor as defined by claim 14, wherein the charge transport layer comprises a binder and a hydrazone charge transport compound.

18. A photoconductor as defined by claim 14, wherein the binder comprises methyl bisphenol A and the additional resin in a weight ratio of from about 1:20 to about 20:1.

19. A photoconductor as defined by claim 14, wherein the charge generation layer is situated between the charge transport layer and the substrate.

20. A photoconductor as defined by claim 14, wherein the charge transport layer is situated between the charge generation layer and the substrate.

21. A photoconductor as defined by claim 14, wherein the binder in the charge generation layer comprises a blend of methyl bisphenol A and polyhydroxystyrene novolak.

22. A photoconductor as defined by claim 21, wherein the charge generation compound comprises a squarylium pigment.

23. A photoconductor as defined by claim 21, wherein the charge generation layer comprises from about 10 to about 40 weight percent of the charge generation compound and from about 60 to about 90 weight percent of the binder.

24. A photoconductor as defined by claim 21, wherein the charge transport layer comprises a binder and a hydrazone charge transport compound.

25. A photoconductor as defined by claim 21, wherein the binder comprises methyl bisphenol A and the polyhydroxystyrene novolak in a weight ratio of from about 1:20 to about 20:1.

26. A photoconductor, comprising a substrate, a charge generation layer and a charge transport layer, wherein the charge generation layer comprises from about 60 to about 90 weight percent of a binder and from about 10 to about 40 weight percent of a squarylium charge generation compound, and further wherein the binder comprises a blend of methyl bisphenol A and a polyhydroxystyrene resin in weight ratio of from about 1:20 to about 20:1.

* * * * *